US010627750B1

(12) United States Patent
Ando

(10) Patent No.: US 10,627,750 B1
(45) Date of Patent: Apr. 21, 2020

(54) FIXING DEVICE AND FIXING METHOD

(71) Applicant: TOSHIBA TEC KABUSHIKI KAISHA, Shinagawa-ku, Tokyo (JP)

(72) Inventor: Masao Ando, Numazu Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/254,657

(22) Filed: Jan. 23, 2019

(51) Int. Cl.
*G03G 15/20* (2006.01)
*G03G 15/00* (2006.01)

(52) U.S. Cl.
CPC ..... *G03G 15/2039* (2013.01); *G03G 15/2053* (2013.01); *G03G 15/5029* (2013.01); *G03G 15/657* (2013.01); *G03G 15/80* (2013.01)

(58) Field of Classification Search
None
See application file for complete search history.

(56) References Cited

U.S. PATENT DOCUMENTS 10,180,645 B1 * 1/2019 Kurosawa ..... G03G 15/2039
2006/0245779 A1 * 11/2006 Sone ..... G03G 15/2042 399/69
2013/0034362 A1 * 2/2013 Matsuura ..... G03G 15/2042 399/69
2017/0364002 A1 12/2017 Ando
2018/0217541 A1 * 8/2018 Nomura ..... G03G 15/2039

* cited by examiner

*Primary Examiner* — Sevan A Aydin

(74) *Attorney, Agent, or Firm* — Amin, Turocy & Watson, LLP

(57) ABSTRACT

A fixing device comprises a cylindrical sheet heating body for heating a sheet; a heat generation section which includes a center heat element that generates heat in a central area, a first heat element that generates heat in a first area containing an end in the length direction, and a second heat element that generates heat in a second area between the central area and the first area; a center temperature measurement section which measures a temperature of a portion of the sheet heating body; a both-end temperature measurement section which measures a temperature of the sheet heating body at a destination by moving in the length direction; and a power controller configured to control electric power to be supplied to the center heat element, to the first heat element, and to the second heat element according to the center temperature measurement section and the both-end temperature measurement section.

20 Claims, 10 Drawing Sheets

FIXING DEVICE AND FIXING METHOD

FIELD

Embodiments described herein relate generally to a fixing device, an image forming apparatus, and a fixing method.

BACKGROUND

In recent years, a fixing device of an image forming apparatus includes a heater divided from a heating section. Such an image forming apparatus can enable the heating section to selectively generate heat in response to a size of a sheet, and can suppress power consumption at the time of heating the sheet. However, in order to control the heating section, it is necessary to measure a temperature of each heating section, or a plurality of temperature detection elements corresponding to the quantity of the heating sections is necessary.

DETAILED DESCRIPTION

In accordance with an embodiment, a fixing device comprises a sheet heating body, a heat generation section, a center temperature measurement section, a both-end temperature measurement section, and a power controller. The sheet heating body has cylindrical shape and heats a conveyed sheet on which a toner image is formed. The heat generation section includes a center heat element that generates heat in a central area containing a center in a length direction perpendicular to a circumferential direction of the sheet heating body, a first heat element that generates heat in a first area containing an end in the length direction and at which a boundary is positioned at a position away from a boundary of the central area by a predetermined distance in the length direction, and a second heat element that generates heat in a second area which is an area between the central area and the first area and does not overlap with the central area and the first area, wherein the center heat element, the first heat element or the second heat element heats the sheet heating body, and a line connecting the center and a center in the length direction of the sheet heating body is perpendicular to the surface of the sheet heating body. The center temperature measurement section configured to measure a temperature of a portion of the sheet heating body heated by the center heat element. The both-end temperature measurement section measures a temperature of the sheet heating body at a destination by moving in the length direction. The power controller controls electric power to be supplied to the center heat element, electric power to be supplied to the first heat element, and electric power to be supplied to the second heat element according to the temperatures measured by the center temperature measurement section and the both-end temperature measurement section.

Figure 1:
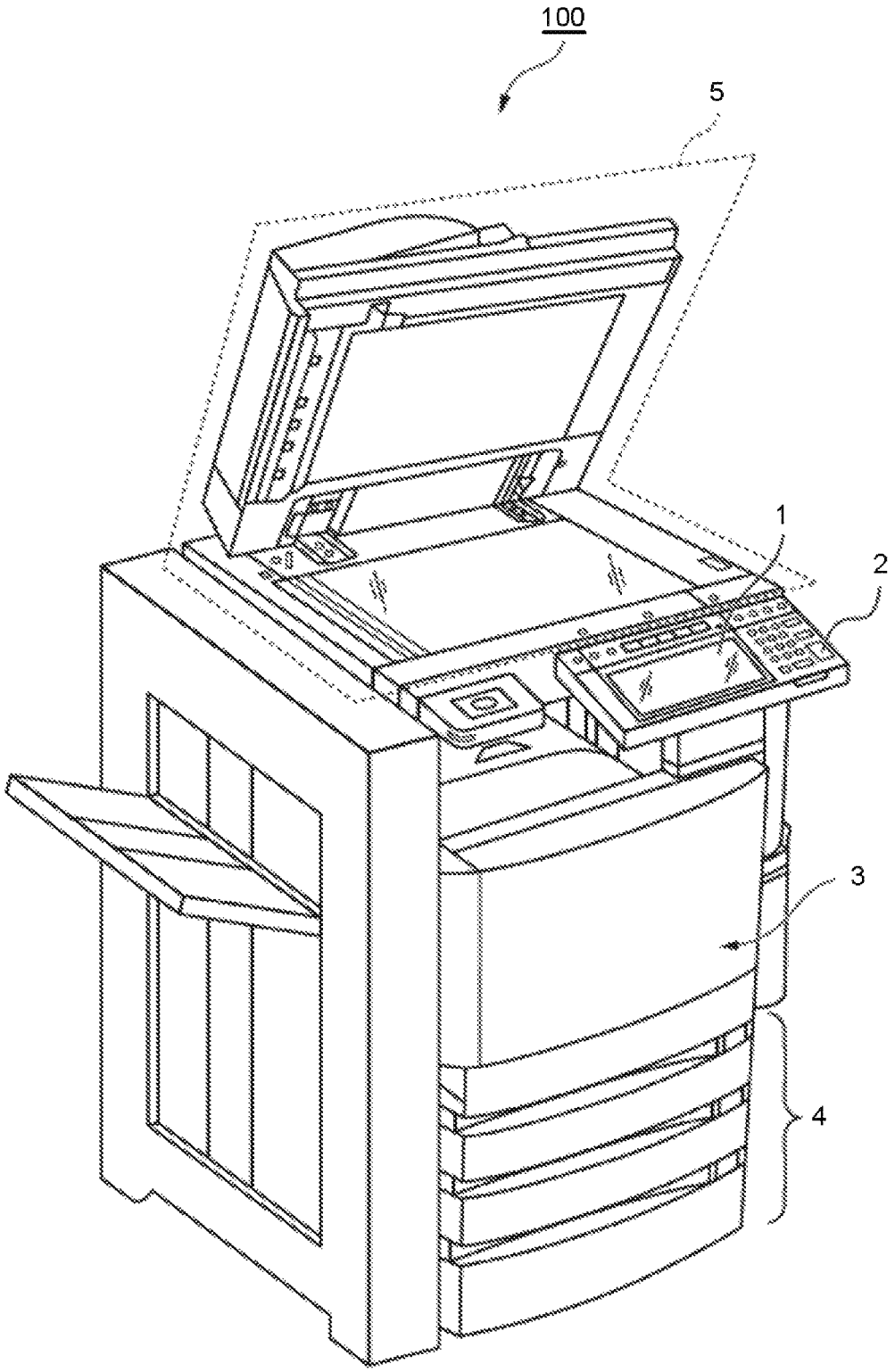
FIG. 1 is an external view illustrating an example of an overall configuration of an image forming apparatus according to an embodiment.

FIG. 1 is an external view illustrating an example of an overall configuration of an image forming apparatus 100 according to an embodiment.

The image forming apparatus 100 includes a display 1, a control panel 2, an image forming section 3, a sheet housing section 4 and an image reading section 5. Furthermore, the image forming section 3 of the image forming apparatus 100 may be a device for forming a toner image or an inkjet type device.

The image forming apparatus 100 reads an image on a sheet and generates digital data to generate an image file. The sheet is, for example, a document, or a paper on which characters or images are recorded. Any type of sheet can be used as long as the image forming apparatus 100 can read the sheet.

The display 1 is an image display device such as a liquid crystal display, an organic EL (Electro Luminescence) display and the like. The display 1 displays various information relating to the image forming apparatus 100.

The control panel 2 includes a plurality of buttons. The control panel 2 receives an operation input from a user. The control panel 2 outputs a signal corresponding to an operation input by the user to a controller of the image forming apparatus 100. The display 1 and the control panel 2 may be integrated with each other to form a touch panel.

The image forming section 3 forms a visible image on the sheet based on image information generated by the image reading section 5 or image information received through a communication path. The image forming section 3 forms an image through the following processing, for example. The image forming section 3 forms an electrostatic latent image on a photoconductive drum based on the image information. The image forming section 3 forms a visible image by attaching a developer to the electrostatic latent image. The toner is provided as a specific example of the developer. A transfer section of the image forming section 3 transfers the visible image onto the sheet. A fixing section 6 described later fixes the visible image transferred onto the sheet on the sheet by heating and pressurizing the sheet. The sheet on which the image is formed may be a sheet accommodated in the sheet housing section 4, or a sheet that is manually fed.

The sheet housing section 4 houses the sheet used for the image formation by the image forming section 3.

The image reading section 5 reads the image information of a reading object as intensity of light. The image reading section 5 records the read image information. The recorded image information may be transmitted to another information processing apparatus via a network. The recorded image information may be used for the image formation on the sheet by the image forming section 3.

Figure 2:
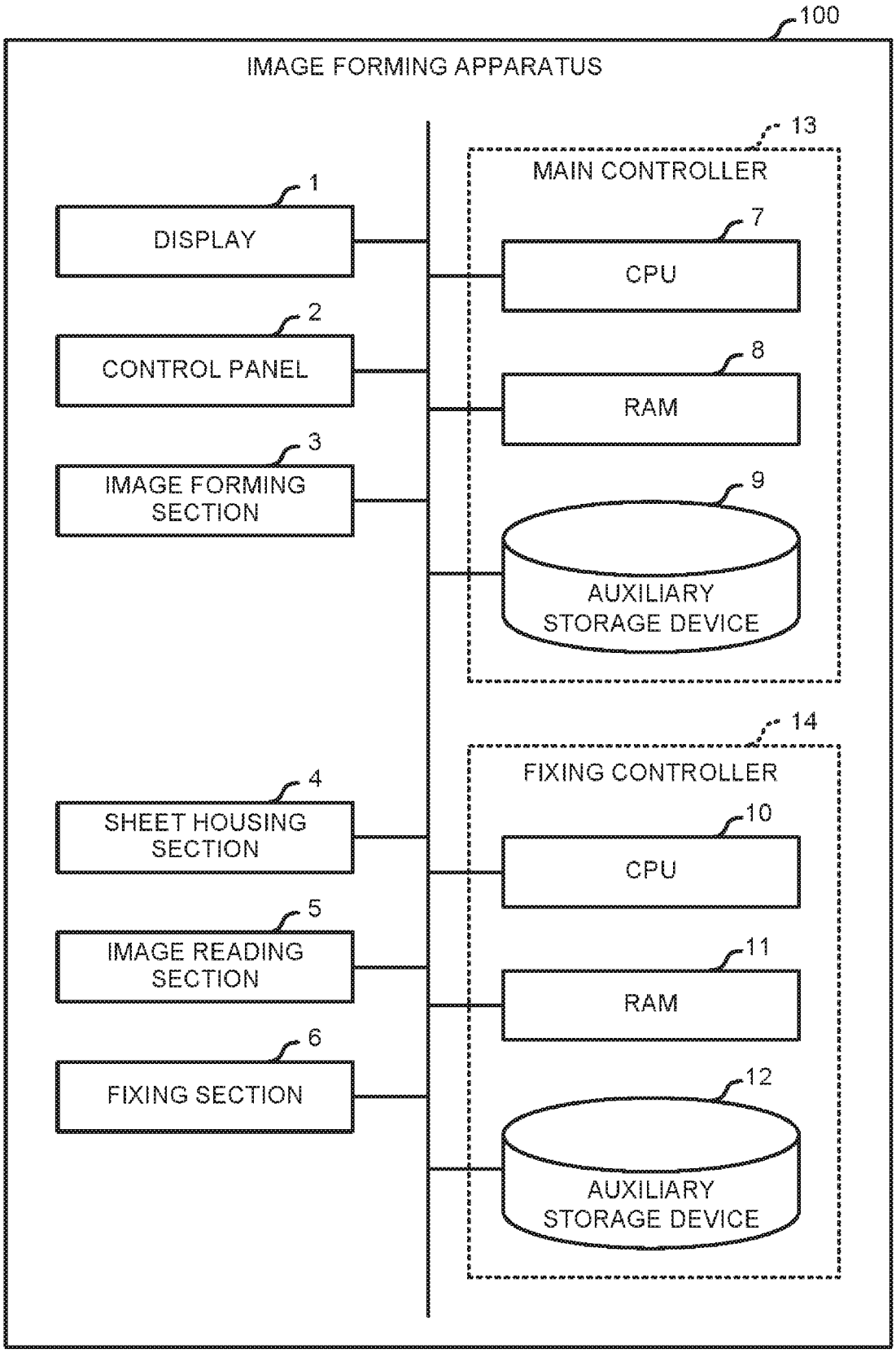
FIG. 2 is a block diagram illustrating specific functional components of the image forming apparatus according to the embodiment.

FIG. 2 is a block diagram illustrating specific functional components of the image forming apparatus 100 according to the embodiment. The image forming apparatus 100 includes CPUs (Central Processing Units) 7 and 10, RAMs (Random Access Memories) 8 and 11, auxiliary storage devices 9 and 12, and the like, which are connected via a bus to execute programs. The image forming apparatus 100 functions as an apparatus including the display 1, the control panel 2, the image forming section 3, the sheet housing section 4, the image reading section 5, and the fixing section 6 through execution of programs.

The CPU 7 reads a program stored in the auxiliary storage device 9 into the RAM 8 and executes it, thereby generating a main controller 13. The CPU 10 reads a program stored in the auxiliary storage device 12 into the RAM 11 and executes it, thereby generating a fixing controller 14. The main controller 13 controls the display 1, the control panel 2, the image forming section 3, the sheet housing section 4, the image reading section 5, and the fixing controller 14. The fixing controller 14 controls the fixing section 6.

The auxiliary storage device 9 is a storage device such as a magnetic hard disk device or a semiconductor storage device. The auxiliary storage device 9 stores various information relating to the operation by the image forming apparatus 100.

The auxiliary storage device 12 is a storage device such as a magnetic hard disk device or a semiconductor storage device. The auxiliary storage device 12 stores various information relating to the operation by the fixing section 6.

Figure 3:
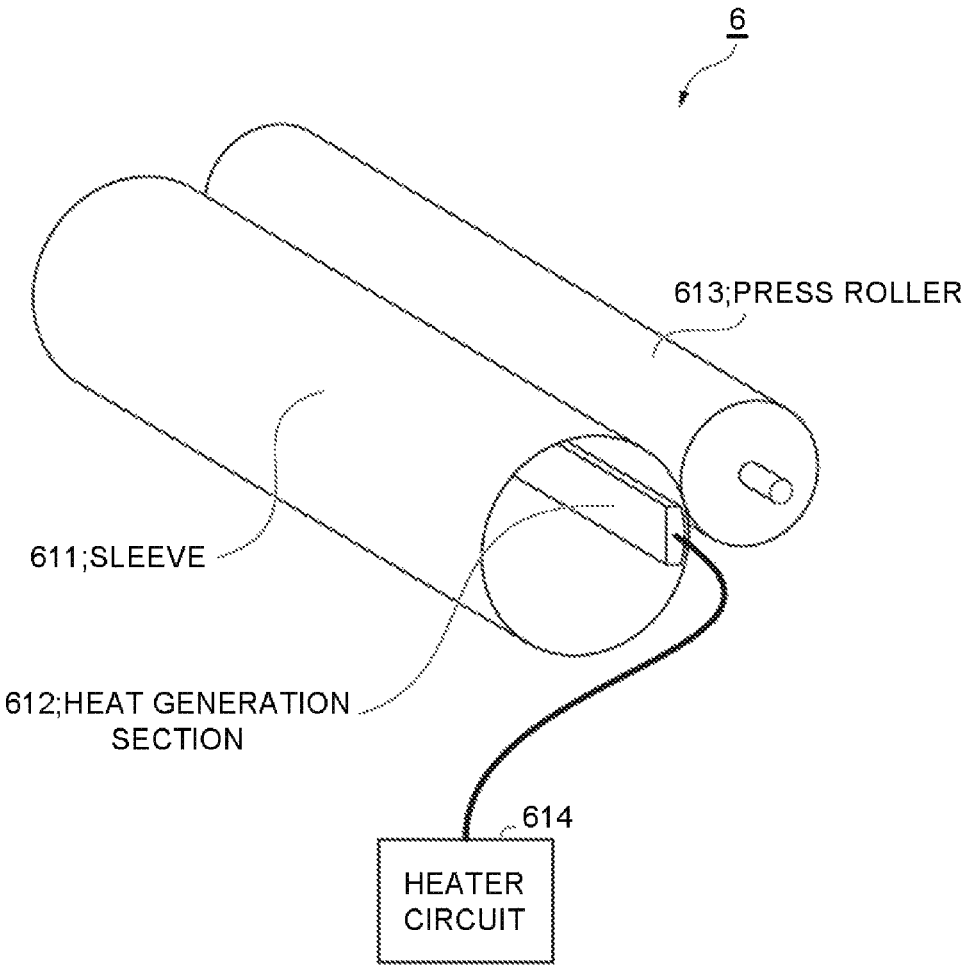
FIG. 3 is a bird's-eye view of a specific example of a fixing section 6 according to the embodiment.

FIG. 3 is a bird's-eye view of a specific example of the fixing section 6 according to the embodiment.

The fixing section 6 includes a sleeve 611, a heat generation section 612, a press roller 613 and a heater circuit 614.

The sleeve 611 is a cylindrical fixing member. The sleeve 611 is, for example, made of a polyimide sleeve. An outer side of the sleeve 611 is a metal layer such as a Ni layer and a Cu layer. The sleeve 611 is supported to be capable of rotating around an axis perpendicular to a paper surface of FIG. 3. The heat generation section 612 is positioned at the inner side of the sleeve 611. The heat generation section 612 heats the sleeve 611 by generating heat. The sleeve 611 rotates with the rotation of the press roller 613. The sleeve 611 forms a fixing nip between the sleeve 611 and the press roller 613. The sleeve 611 fixes a visible image such as a toner image on a sheet with the formed fixing nip.

Hereinafter, for convenience of description, a direction perpendicular to a circumferential direction of the sleeve 611 is referred to as a length direction.

The press roller 613 is pressed against the sleeve 611 to form the fixing nip between the sleeve 611 and the press roller 613.

The heat generation section 612 includes a plurality of heat elements. The heat element receives supply of electric power to generate heat. The heat generation section 612 applies heat to the sleeve 611 by the heat generation by the heat element. The heat generation section 612 has a central area, a first area and a second area. The central area contains a center in the length direction of the heat generation section 612. The first area includes an end in the length direction of the heat generation section 612. A boundary of the first area is positioned away from a boundary of the central area by a predetermined distance. The second area is an area between the central area and the first area, and does not overlap with the central area and the first area.

A line connecting the center in the length direction of the heat generation section 612 and the center in the length direction of the sleeve 611 is perpendicular to the surface of the sleeve 611.

One of the plurality of the heat elements of the heat generation section 612 is positioned in the central area. Hereinafter, the heat element positioned in the central area is referred to as a center heat element. The heat generation section 612 has heat elements positioned in the first area and the second area as heat elements other than the center heat element. Hereinafter, the heat elements positioned in the first area and the second area are referred to as both-end heat elements. In each of the heat elements, all or a part of the heat elements may generate heat. Hereinafter, a location which generates heat in each heat element is referred to as a heat generation position. The heat generation position may be positioned anywhere in each heat element as long as it generates heat. For convenience of description, it is assumed that the heat generation position is near the center of each heat element.

The heater circuit 614 supplies electric power to the heat generation section 612.

Figure 4:
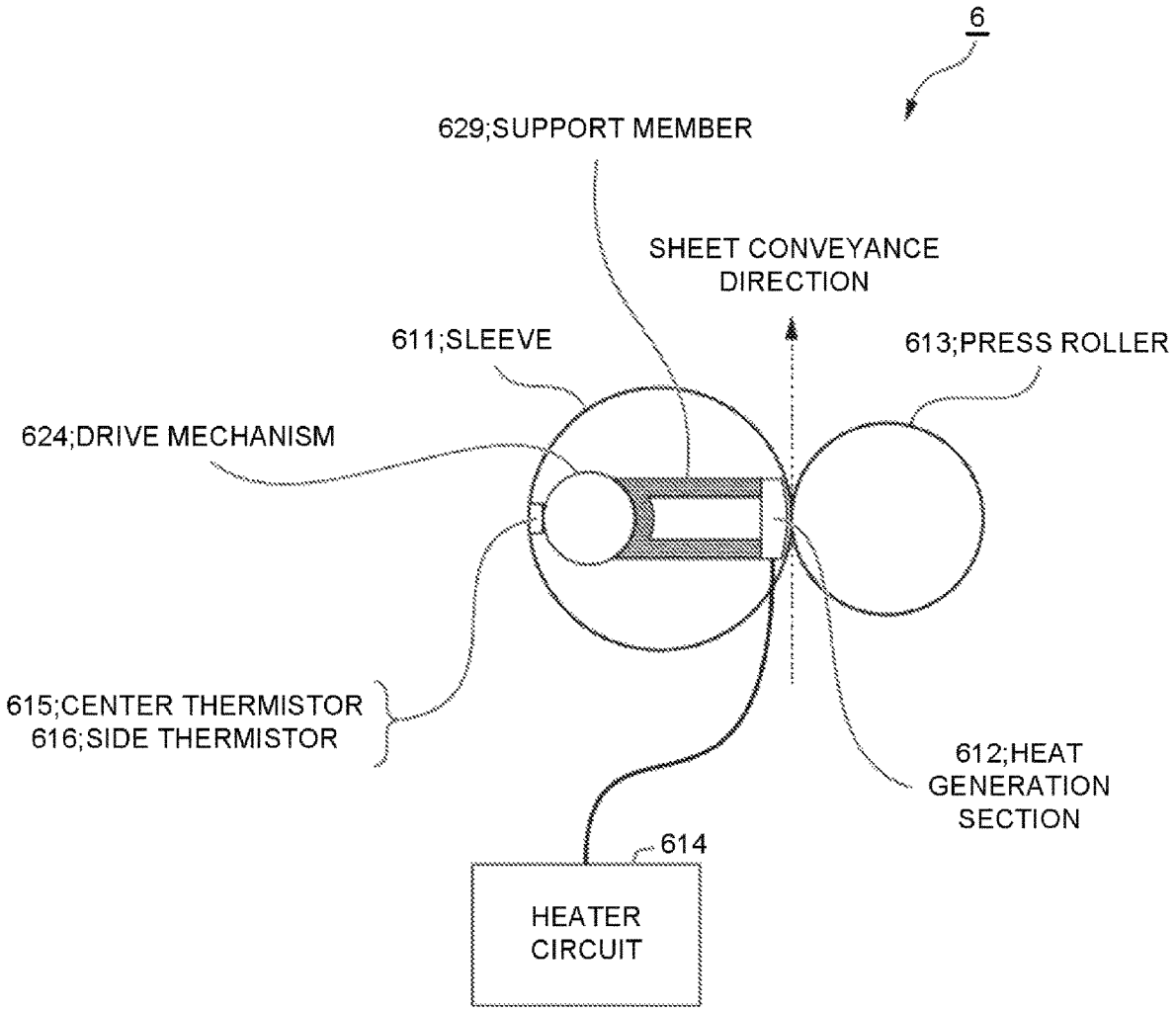
FIG. 4 is a sectional view of a specific example of the fixing section 6 according to the embodiment.

FIG. 4 is a cross-sectional view of a specific example of the fixing section 6 according to the embodiment.

The fixing section 6 includes a center thermistor 615, a side thermistor 616, a drive mechanism 624 and a support member 629. The center thermistor 615 is positioned on the opposite side of the center heat element across a rotation axis of the sleeve 611. The center thermistor 615 measures a temperature of a center heated portion. The center heated portion, which is a portion on the surface of the sleeve 611, passes through the vicinity of the center heat element by the rotation of the sleeve 611. The center heated portion is heated by the center heat element when it passes through the vicinity of the center heat element. The side thermistor 616 is positioned on the opposite side of the both-end heat elements across a plane including the rotation axis of the sleeve 611. The plane is perpendicular to a perpendicular line connecting the rotation axis of the sleeve 611 and the rotation axis of the press roller 613. The side thermistor 616 measures the temperature of both-end heated portions. The both-end heated portions, which are portions on the surface of the sleeve 611, pass through the vicinity of the both-end heat elements by the rotation of the sleeve 611. The both-end heated portions are heated by the both-end heat elements as they pass through the vicinity of the both-end heat elements. The side thermistor 616 is movable between a plurality of the both-end heated portions. Hereinafter, a direction parallel to the perpendicular line connecting the rotation axis of the sleeve 611 and the rotation axis of the press roller 613 is referred to as a perpendicular direction.

In this manner, the temperature measured by the center thermistor 615 is a temperature of the vicinity of the center heat element when viewed from the perpendicular direction. The temperature measured by the side thermistor 616 is a temperature of the vicinity of the both-end heat elements when viewed from the perpendicular direction.

The drive mechanism 624 moves the side thermistor 616.

The support member 629 holds the drive mechanism 624.

The sheet is conveyed while being sandwiched between the sleeve 611 and the press roller 613. For example, a sheet conveying direction in which the sheet is conveyed is a direction from the bottom towards the top of a paper surface in FIG. 4. The sheet is conveyed in such a manner that a center thereof in a width direction orthogonal to the conveyance direction overlaps with the center in the length direction of the sleeve 611 by a conveyance guide (not shown).

Figure 5:
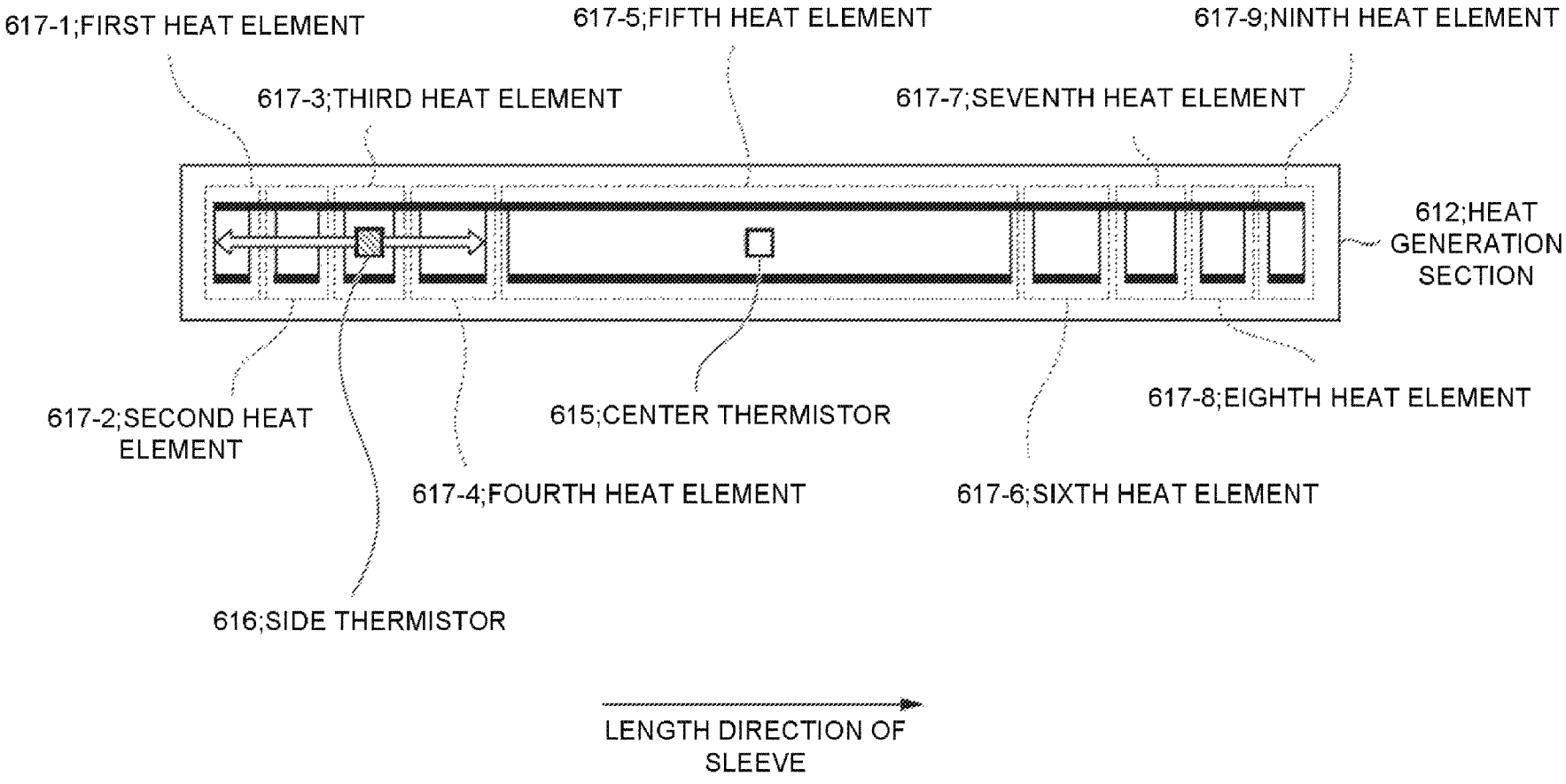
FIG. 5 is a diagram illustrating a specific example of a heat generation section 612 according to the embodiment.

FIG. 5 is a diagram illustrating a specific example of the heat generation section 612 according to the embodiment.

In FIG. 5, the heat generation section 612 includes nine heat elements, i.e., a first heat element 617-1 to a ninth heat element 617-9, the center thermistor 615 and the side thermistor 616. In FIG. 5, the heat generation section 612 includes the first heat element 617-1 to the ninth heat element 617-9 in order in the length direction of the sleeve 611 from one end of the heat generation section 612 to the other end thereof. The fifth heat element 617-5 is a specific example of the center heat element. The first heat element 617-1 to the fourth heat element 617-4 are specific examples of the both-end heat elements positioned at one end side of the heat generation section 612 which is also one end side in the length direction of the sleeve 611. The sixth heat element 617-6 to the ninth heat element 617-9 are specific examples of the both-end heat elements positioned at the other end side of the heat generation section 612 which is also the other end side in the length direction of the sleeve 611.

The center thermistor 615 is positioned at the same position as the fifth heat element 617-5 which is the center heat element when viewed from the perpendicular direction (i.e., a direction perpendicular to the paper surface). The side thermistor 616 is movable between the vicinity of the first heat element 617-1 and the vicinity of the fourth heat element 617-4. In FIG. 5, the side thermistor 616 is positioned at the same position as any one of the first heat element 617-1 to the fourth heat element 617-4 which are the both-end heat elements when viewed from the perpendicular direction.

Figure 6:
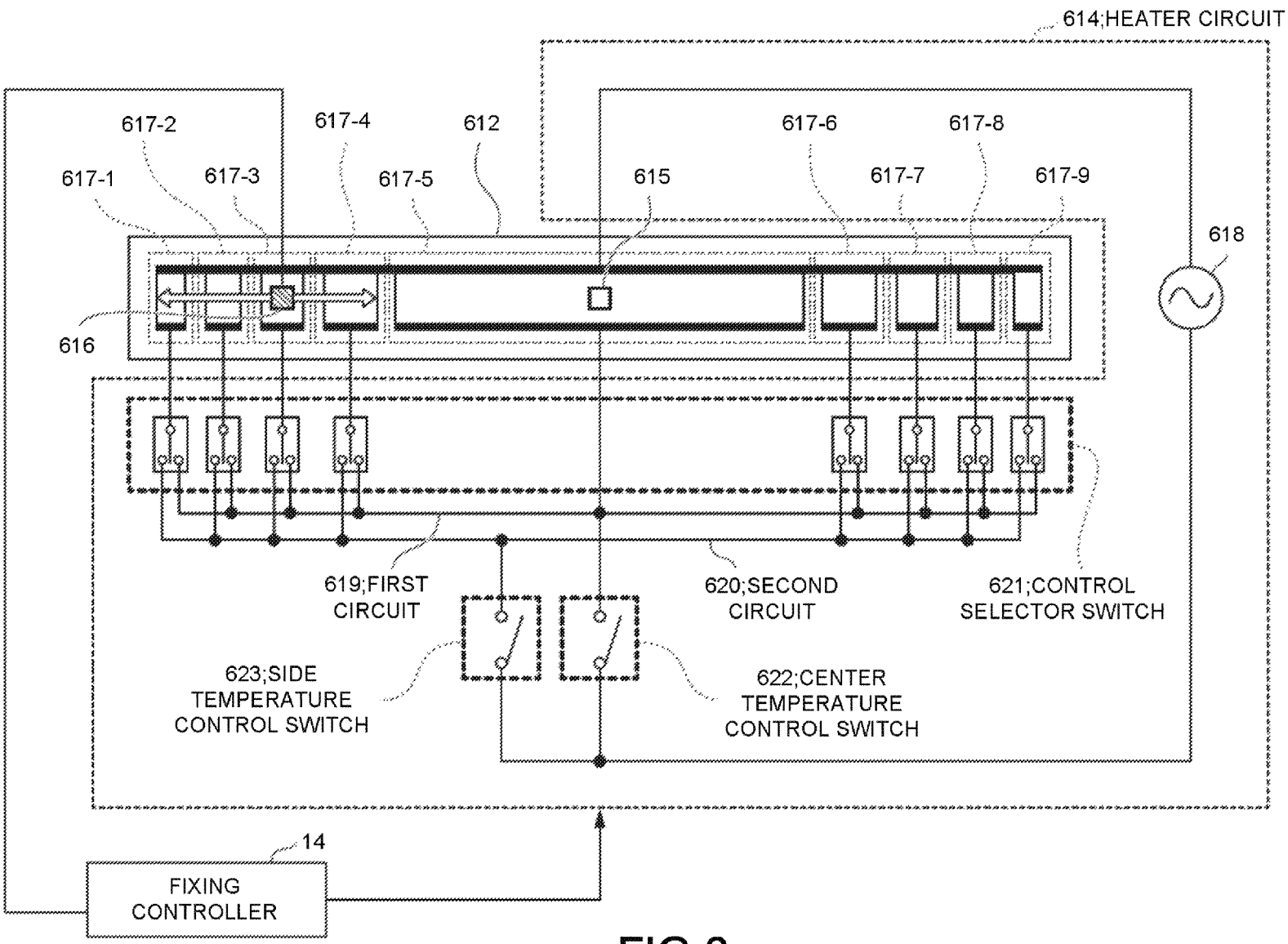
FIG. 6 is a diagram illustrating a specific example of a heater circuit 614 according to the embodiment.

FIG. 6 is a diagram illustrating a specific example of the heater circuit 614 according to the embodiment.

The heater circuit 614 includes two circuits having common power supply 618 and also having the heat generation section 612 as a load. The power supply 618 is an AC power supply. The heater circuit 614 supplies the electric power provided by the power supply 618 to the heat generation section 612 with the two circuits. Hereinafter, the two circuits included in the heat generation section 612 are referred to as a first circuit 619 and a second circuit 620, respectively.

The first circuit 619 supplies the electric power supplied by the power supply 618 to the center heat element and the both-end heat elements. The first circuit 619 includes a control selector switch 621 and a center temperature control switch 622. The control selector switch 621 switches the state of each of the both-end heat elements included in the heat generation section 612 to a first ON state, a second ON state, or an OFF state. The first ON state of the both-end heat elements is a state in which the both-end heat elements are connected to the first circuit 619. The second ON state of the both-end heat elements is the state in which the both-end heat elements are connected to the second circuit 620. The OFF state of the both-end heat elements is a state in which the both-end heat elements are not connected to either the first circuit 619 or the second circuit 620. The electric power of the both-end heat elements in the first ON state is supplied by the first circuit 619. The electric power of the both-end heat elements in the second ON state is supplied by the second circuit 620. No power is supplied to the both-end heat elements in the OFF state.

The center temperature control switch 622 switches the state of the first circuit 619 between an ON state and an OFF state. The ON state of the first circuit 619 is a state in which the first circuit 619 is a closed circuit with the heat generation section 612 as the load. The OFF state of the first circuit 619 is a state in which the first circuit 619 is an open circuit with the heat generation section 612 as the load and the center temperature control switch 622 as an open end thereof. When the first circuit 619 is in the ON state, the electric power is supplied to the center heat element and the both-end heat elements in the first ON state. When the first circuit 619 is in the OFF state, no electric power is supplied to the heat generation section 612 in the first ON state or in the OFF state.

The second circuit 620 supplies the electric power supplied by the power supply 618 only to the both-end heat elements. The second circuit 620 includes a control selector switch 621 shared with the first circuit 619 and a side temperature control switch 623. The side temperature control switch 623 switches the state of the second circuit 620 between an ON state and an OFF state. The ON state of the second circuit is a state in which the second circuit 620 is a closed circuit with the heat generation section 612 as the load. The OFF state of the second circuit 620 is a state in which the second circuit 620 is an open circuit with the heat generation section 612 as the load and the side temperature control switch 623 as an open end. When the second circuit 620 is in the ON state, the electric power is supplied only to the both-end heat elements in the second ON state. When the second circuit 620 is in the OFF state, no electric power is supplied to the heat generation section 612 in the second ON state or in the OFF state.

Below, if the center temperature control switch 622 and the side temperature control switch 623 are not distinguished from each other, they are referred to as temperature switches.

In FIG. 5 and FIG. 6, the heat generation section 612 has nine heat elements, but the heat generation section 612 does not necessarily have nine heat elements. The heat generation section 612 may include ten or more heat elements or less than nine heat elements. However, it is desired that the number of the heat elements of the heat generation section 612 is an odd number and the heat elements are bilaterally symmetrical in the length direction of the sleeve 611, as shown in FIG. 5 or FIG. 6.

Hereinafter, for convenience of description, the number of the heat elements of the heat generation section 612 is an odd number and the heat elements are bilaterally symmetrical in the length direction of the sleeve 611, as shown in FIG. 5 or FIG. 6.

In such a case, the side thermistor 616 is not necessarily movable in the vicinity of the both-end heated portions heated by all the both-end heat elements of the heat generation section 612. When the heat elements of the heat generation section 612 are bilaterally symmetrical in the length direction of the sleeve 611, the temperature of the heat elements positioned at the target portion of the heat generation section 612 is substantially the same. Therefore, the side thermistor 616 only needs to move to the vicinity of the both-end heated portions heated by the both-end heat elements at one end side of the heat generation section 612.

Hereinafter, for convenience of description, it is assumed that the side thermistor 616 moves with only the both-end heated portions heated by the both-end heated elements at one side of the heat generation section as a destination.

Figure 7:
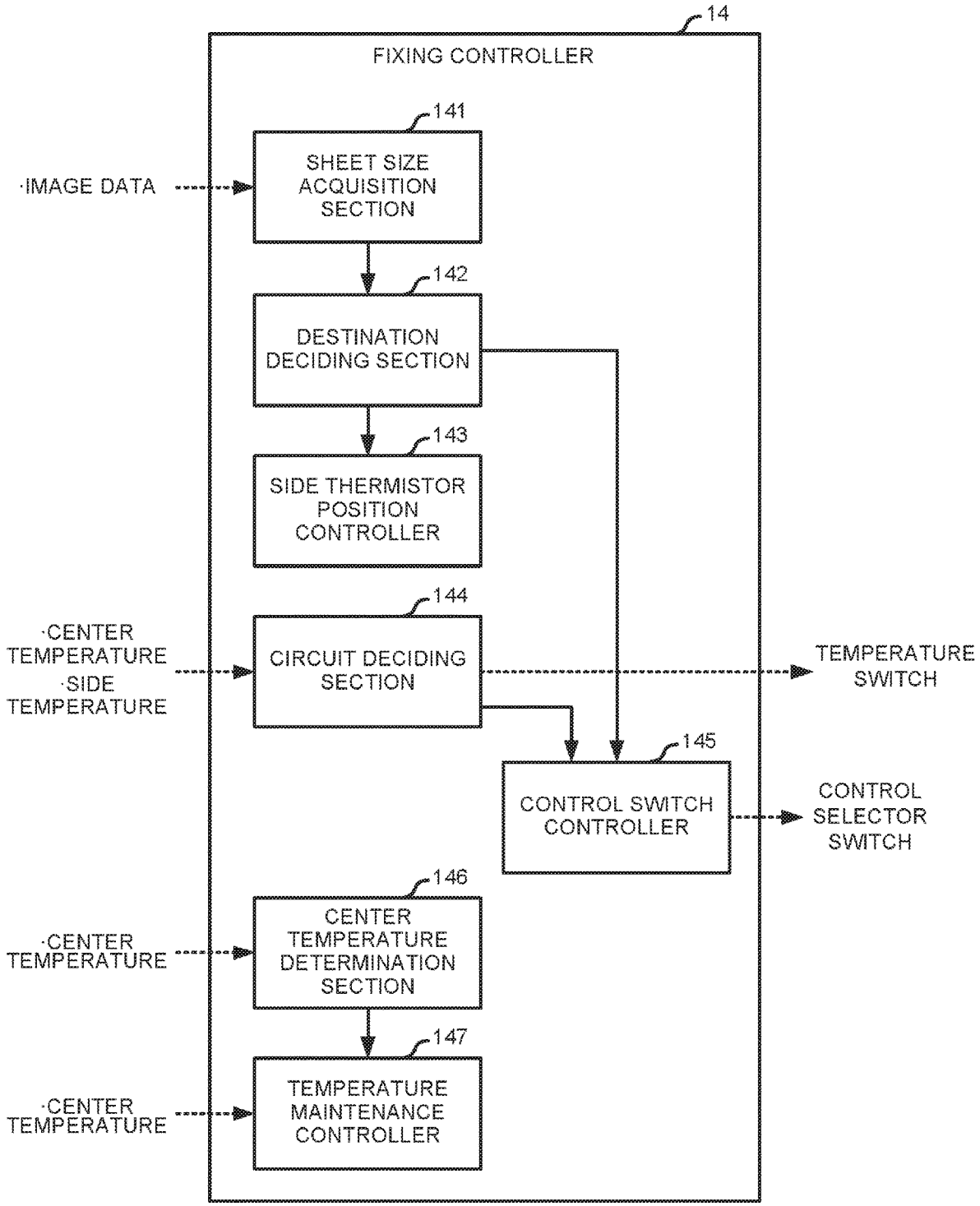
FIG. 7 is a diagram illustrating a specific example of the functional components of a fixing controller 14 according to the embodiment.

FIG. 7 is a diagram illustrating a specific example of the functional components of the fixing controller 14 according to the embodiment. The fixing controller 14 includes a sheet size acquisition section 141, a destination deciding section 142, a side thermistor position controller 143, a circuit deciding section 144, a control switch controller 145, a center temperature determination section 146 and a temperature maintenance controller 147.

The sheet size acquisition section 141 acquires sheet size information. The sheet size information indicates a size of the sheet conveyed to the fixing section 6. The sheet size information may be acquired in any way, for example, the sheet size information may be acquired based on an image of the sheet read by the image reading section 5. The sheet size information may be acquired by an input to the control panel 2 by a user.

The destination deciding section 142 executes a destination deciding processing. The destination deciding section 142 decides a destination heated portion by executing the destination deciding processing. The destination heated portion is the both-end heated portion to be heated by a destination heat element. The destination heat element is a both-end heat element which satisfies the following position condition of the side thermistor. The position condition of the side thermistor is described below. For convenience of description, the definition of some terms is made here.

Hereinafter, the heat element of the heat generation section 612 is referred to as an mth heat element (m is an integer from 1 to M, and M is an odd number) in order from one end in the length direction of the sleeve 611. The heat elements from the first heat element to the ((M−1)/2)th heat element are the both-end heat elements positioned on the side close to one end of the heat generation section 612. The heat elements from the ((M+3)/2)th heat element to the Mth heat element are the both-end heat elements positioned on the side close to the other end of the heat generation section 612. The center heat element is positioned between the ((M−1)/2)th heat element and the ((M+3)/2)th heat element. The center heat element is the ((M+1)/2)th heat element. Hereinafter, ((M+1)/2) is described as c. Hereinafter, a length of the mth heat element in the length direction of the sleeve is referred to as Lm. For example, a length of the third heat element is L3. For example, Lc is a length of the center heat element in the length direction of the sleeve 611.

Based on this definition, the position condition of the side thermistor is described.

The position condition of the side thermistor is expressed by the following Equation (1), with the destination heat element as the kth heat element (k is an integer equal to or greater than 1 and less than (M+3)/2). In the Equation (1), Ls represents the length of the sheet in the length direction of the sleeve 611. In Equation (1), i is an integer.

(Equation 1)

$$L_s = L_c + \Sigma_{i=k}^{(M-1)/2}(L_i + L_{(M-(i+1))}) \quad (1)$$

Equation (1) indicates that a both-end heat element satisfying a condition that a distance between the center of the center heat element and a center of the both-end heat element is half the size of the sheet indicated by the sheet size information is the destination heat element.

The destination deciding section 142 decides a both-end heated portion heated by the kth heat element satisfying the position condition of the side thermistor as the destination heated portion by executing the destination deciding processing.

The side thermistor position controller 143 moves the side thermistor 616 to the vicinity of the destination heated portion decided by the destination deciding section 142. The vicinity of the destination heated portion decided by the destination deciding section 142 is a predetermined position determined for each destination heated portion and is a position at which the temperature of the destination heated portion can be measured.

The circuit deciding section 144 decides one of the first circuit 619 and the second circuit 620 as a power supply circuit based on the center temperature and the side temperature. The center temperature is measured by the center thermistor 615. The side temperature is measured by the side thermistor 616. The power supply circuit supplies the electric power to the heat generation section 612. The circuit deciding section 144 turns on the decided power supply circuit by controlling the temperature switch.

The control switch controller 145 controls the control selector switch 621 based on the decision of the destination deciding section 142 and the decision of the circuit deciding section 144. Specifically, the control switch controller 145 sets each heat element of the kth heat element to the ((c−k)+c)th heat element to a pth ON state. k is an integer of or more. p is 1 or 2. The kth heat element is the destination heat element. The pth ON state means the first ON state when the circuit decided as the power supply circuit by the circuit deciding section 144 is the first circuit 619. The pth ON state means the second ON state when the circuit decided as the power supply circuit by the circuit deciding section 144 is the second circuit 620.

The center temperature determination section 146 acquires the center temperature and determines whether or not the center temperature is a predetermined temperature (hereinafter, referred to as a "first temperature"). The center temperature determination section 146 may perform determination at any timing as long as the determination can be performed at time interval sufficiently earlier than the time at which the center temperature changes.

The temperature maintenance controller 147 performs a temperature control processing when the determination result of the center temperature determination section 146 is the first temperature. The temperature maintenance controller 147 maintains the center temperature at the first temperature by performing the temperature control processing. The temperature control processing may be any processing as long as the center temperature can be maintained at the first temperature through the processing. For example, the temperature control processing may be a processing of maintaining the center temperature at the first temperature by switching that state of the first circuit 619 between the ON state and the OFF state at predetermined intervals. The temperature maintenance controller 147 controls the center temperature control switch 622 to switch the state of the first circuit 619 between the ON state and the OFF state.

Figure 8:
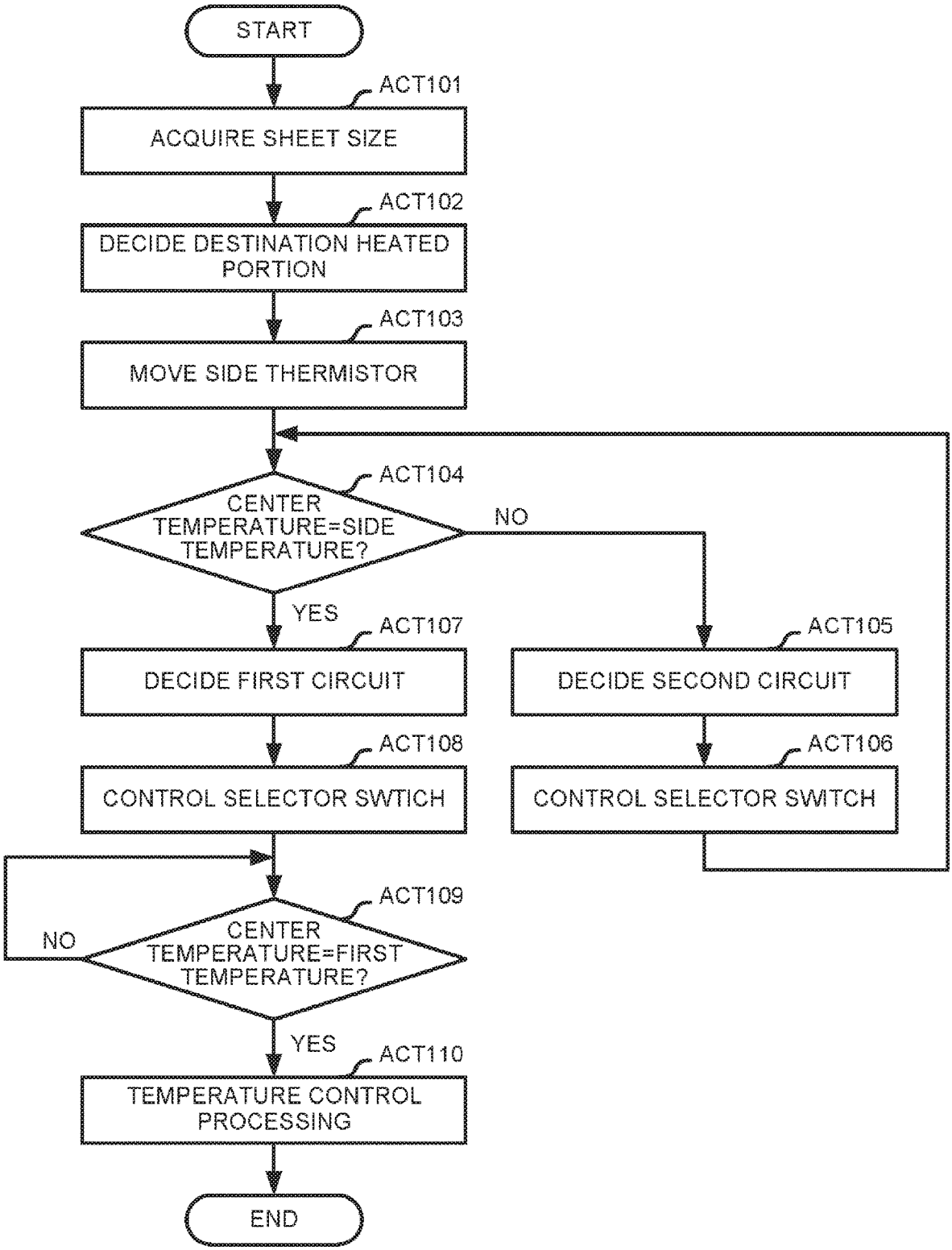
FIG. 8 is a flowchart depicting a flow of a specific processing in which the fixing controller 14 controls a temperature of the heat generation section 612 according to the embodiment.

FIG. 8 is a flowchart depicting a flow of a specific processing in which the fixing controller 14 controls the temperature of the heat generation section 612 according to the embodiment. Hereinafter, for convenience of description, it is assumed that the center temperature determination section 146 makes a determination at a predetermined time interval T1.

The sheet size acquisition section 141 acquires the sheet size information (ACT 101). Based on the sheet size information, the destination deciding section 142 decides the destination heated portion (ACT 102). The side thermistor position controller 143 moves the side thermistor 616 to the vicinity of the destination heated portion (ACT 103). After ACT 103, the circuit deciding section 144 decides the power supply circuit based on the center temperature and the side temperature. Specifically, first, the circuit deciding section 144 acquires the center temperature and the side temperature, and determines whether or not the center temperature and the side temperature are the same (ACT 104). The circuit deciding section 144 determines that the center temperature and the side temperature are the same if a temperature difference between the center temperature and the side temperature is within a predetermined temperature range. If the center temperature and the side temperature are not the same (No in ACT 104), the circuit deciding section 144 decides the second circuit 620 as the power supply circuit (ACT 105). After ACT 105, the control switch controller 145 sets the state of each heat element of the kth heat element to the ((c−k)+c)th heat element to the second ON state with the kth heat element as the destination heat element (ACT 106). By the processing in ACT 106, the electric power is supplied to each heat element of the kth heat element to the ((c−k)+c)th heat element except for the center heat element. As the electric power is supplied, each heat element of the kth heat element to the ((c−k)+c)th heat element except for the center heat element generates heat. After ACT 106, the flow returns to the processing in ACT 104.

In ACT 104, if the center temperature and the side temperature are the same (Yes in ACT 104), the circuit deciding section 144 decides the first circuit 619 as the power supply circuit (ACT 107). After ACT 107, the control switch controller 145 sets the state of each heat element of the kth heat element to the ((c−k)+c)th heat element to the first ON state with the kth heat element as the destination heat element (ACT 108). By the processing in ACT 106, the electric power is supplied to each heat element of the kth heat element to the ((c−k)+c)th heat element. As the electric power is supplied, each heat element of the kth heat element to the ((c−k)+c)th heat element generates heat. The center temperature determination section 146 determines whether or not the center temperature is the first temperature (ACT 109). If the center temperature is not the first temperature (No in ACT 109), the supply of the electric power to each heat element of the kth heat element to the ((c−k)+c)th heat element is continued, and the processing in ACT 109 is executed in each predetermined time interval T1.

On the other hand, if the center temperature is the first temperature (Yes in ACT 109), the temperature maintenance controller 147 executes the temperature control processing (ACT 110).

The image forming apparatus 100 configured as described above includes the heat generation section 612 having a plurality of heat elements that generate heat, and the side thermistor 616 that can be moved to the destination heated portion heated by the destination heat element. Therefore, the image forming apparatus 100 configured as described above can suppress the increase in the number of thermometers for measuring the temperature of the heat element in accordance with the number of heat elements.

(Drive Mechanism of Side Thermistor)

The drive mechanism 624 for moving the side thermistor 616 may be any mechanism as long as it can move the side thermistor 616. A specific example of the drive mechanism 624 for moving the side thermistor 616 is described with reference to FIG. 9.

Figure 9:
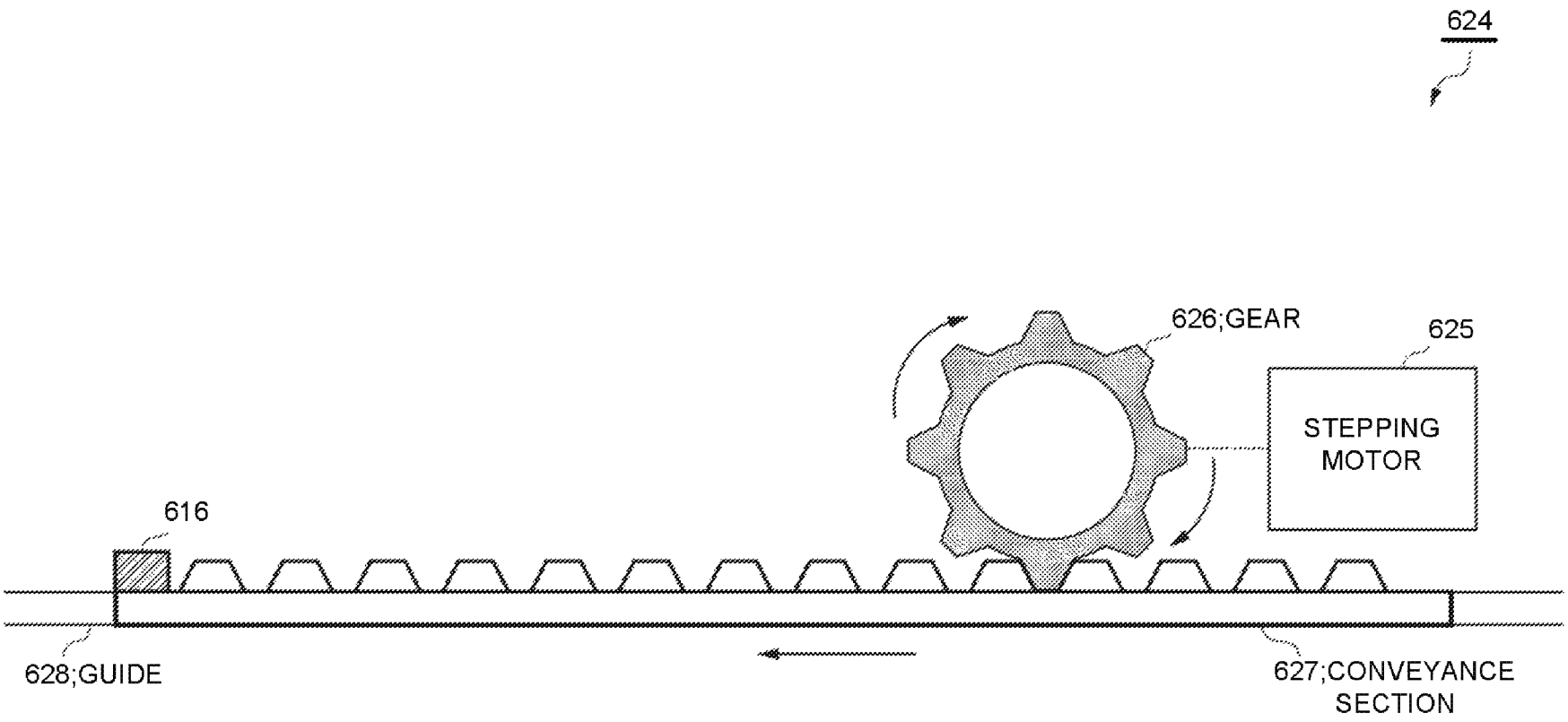
FIG. 9 is a diagram illustrating an example of a drive mechanism according to the embodiment.

FIG. 9 is a diagram illustrating an example of the drive mechanism 624 according to the embodiment.

The drive mechanism 624 shown in FIG. 9 includes a stepping motor 625, a gear 626, a conveyance section 627, and a guide 628. The stepping motor 625 rotates the gear 626 by an angle corresponding to the destination heat element under the control of the side thermistor position controller 143. The gear 626 rotates by the rotation of the stepping motor 625, and transmits a part of the power for rotation to the conveyance section 627.

The conveyance section 627 moves horizontally from the left to right of the paper surface along the guide 628 by a distance proportional to the rotation angle of the gear 626 through the power transmitted from the gear 626. The side thermistor 616 is fixed to the conveyance section 627, and the side thermistor 616 also moves horizontally due to the parallel movement of the conveyance section 627.

The side thermistor 616 is moved to the destination heated portion heated by the destination heat element by such a mechanism, for example.

The sleeve 611 may be any member as long as it can be heated by the heat generation section 612. The sleeve 611 may be, for example, a film or a belt.

(Modification)

The fixing section 6 may further include a side thermistor 616*a*.

Figure 10:
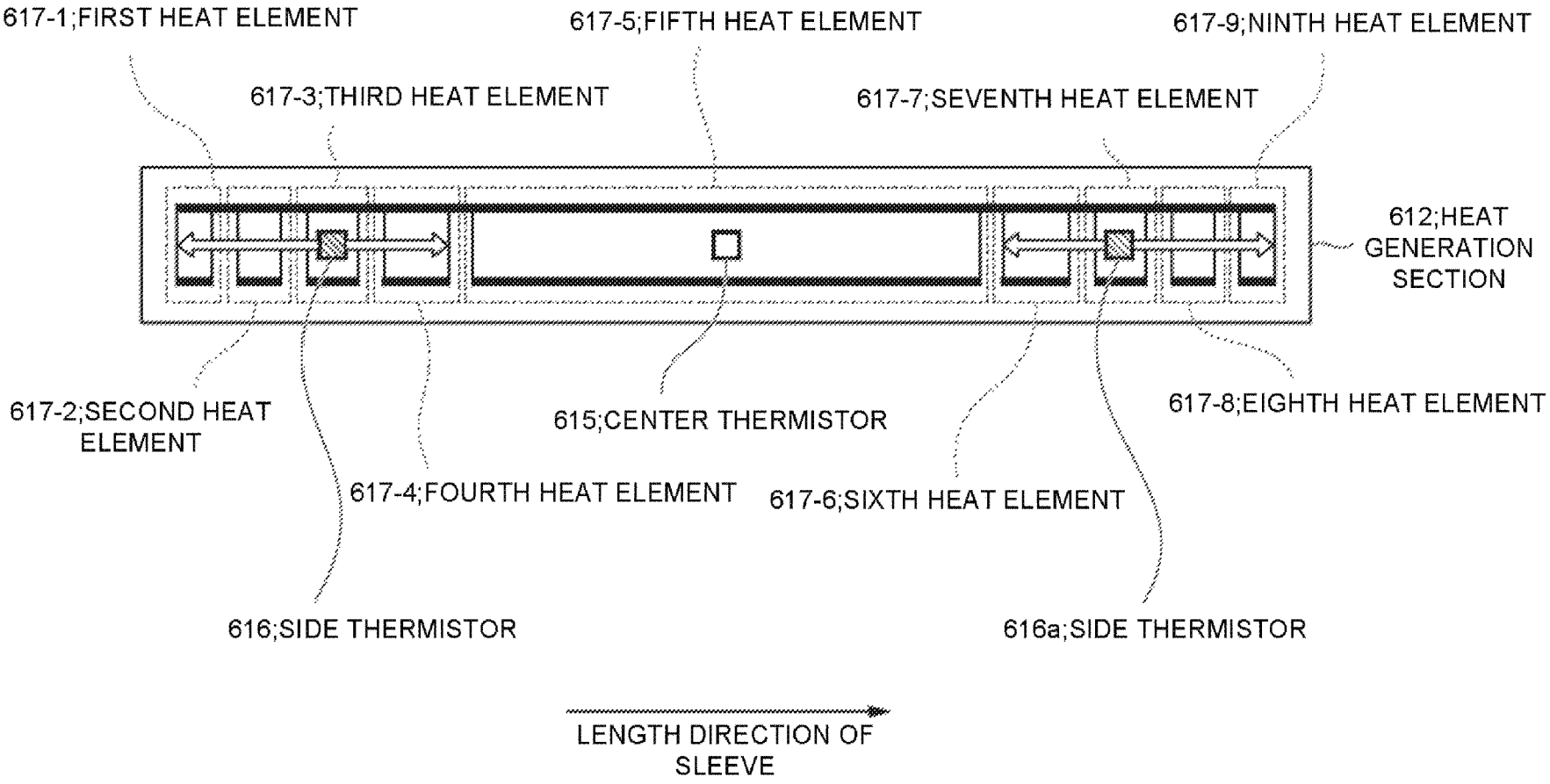
FIG. 10 is a diagram illustrating a specific example of a side thermistor 616*a* according to a modification.

FIG. 10 is a diagram illustrating a specific example of the side thermistor 616*a* according to the modification. The components having the same functions as those in FIG. 5 are denoted with the same reference numerals in FIG. 10, and the description thereof is omitted.

The side thermistor 616*a* is positioned on the opposite side of the side thermistor 616 across the center thermistor 615. Like the side thermistor 616, the side thermistor 616*a* is movable between a plurality of the both-end heated portions. The side thermistor 616*a* is moved between the both-end heated portions so as to be positioned at a position symmetrical to the side thermistor 616. For example, the side thermistor 616*a* is moved from the ninth heat element 617-9 to the eighth heat element 617-8 when the side thermistor 616 is moved from the first heat element 617-1 to the second heat element 617-2.

The side thermistor 616*a* is moved between both-end heated portions by a mechanism similar to the drive mechanism 624.

The circuit deciding section 144 and the control switch controller 145 are examples of the power controller. If the second heat element 617-2 is an example of a first both-end heat element, for example, the third heat element 617-3 is an example of a second both-end heat element. If the third heat element 617-3 is an example of the first both-end heat element, for example, the fourth heat element 617-4 is an example of the second both-end heat element. If the ninth heat element 617-9 is an example of the first both-end heat element, for example, the eighth heat element 617-8 is an example of the second both-end heat element. If the eighth heat element 617-8 is an example of the first both-end heat element, for example, the seventh heat element 617-7 is an example of the second both-end heat element.

The center thermistor 615 is an example of a center temperature measurement section. The side thermistor 616 is an example of a both-end temperature measurement section. The destination deciding section 142 is an example of a position determination section. The sheet size acquisition section 141 is an example of a size information acquisition section.

The first ON state and the second ON state are examples of a connection state. The OFF state is an example of a disconnection state.

All or a part of the functions of the image forming apparatus 100 may be realized by using hardware such as an ASIC (Application Specific Integrated Circuit), a PLD (Programmable Logic Device), a FPGA (Field Programmable Gate Array) or the like. The program may be recorded on a computer-readable recording medium. The computer-readable recording medium is, for example, a portable medium such as a flexible disk, a magneto-optical disk, a ROM (Read Only Memory), a CD-ROM (Compact Disc Read-Only Memory) or the like, or a storage device such as a hard disk built in a computer system. The program may be transmitted via an electric communication line.

While certain embodiments have been described these embodiments have been presented by way of example only, and are not intended to limit the scope of the inventions. Indeed, the novel embodiments described herein may be embodied in a variety of other forms: furthermore various omissions, substitutions and changes in the form of the embodiments described herein may be made without departing from the spirit of the inventions. The accompanying claims and their equivalents are intended to cover such forms or modifications as would fall within the scope and spirit of the invention.

What is claimed is:

1. A fixing device, comprising:

a sheet heating body having a cylindrical shape and configured to heat a conveyed sheet on which a toner image is formed;

a heat generation section comprising a center heat element that generates heat in a central area containing a center in a length direction perpendicular to a circumferential direction of the sheet heating body, a first heat element that generates heat in a first area containing an end in the length direction and at which a boundary is positioned at a position away from a boundary of the central area by a predetermined distance in the length direction, and a second heat element that generates heat in a second area between the central area and the first area and does not overlap with the central area and the first area, wherein at least one of the center heat element, the first heat element, and the second heat element heats the sheet heating body;

a center temperature measurement section configured to measure a temperature of a portion of the sheet heating body heated by the center heat element;

a both-end temperature measurement section configured to measure a temperature of the sheet heating body at a destination by movement in the length direction; and a power controller configured to control electric power to be supplied to the center heat element, to the first heat element, and to the second heat element according to the temperatures measured by the center temperature measurement section and the both-end temperature measurement section, wherein if the temperatures measured by the center temperature section and the both-end temperature measurement section are not within a predetermined range, the power controller is configured to supply the electric power to the center heat element, to the first heat element, and to the second heat element independently, and wherein if the temperatures measured by the center temperature section and the both-end temperature measurement section are within the predetermined range, the power controller is configured to supply the electric power to the center heat element, to the first heat element, and to the second heat element integrally.

2. The fixing device according to claim 1, wherein the sheet is conveyed in such a manner that a center thereof in a width direction orthogonal to a conveyance direction of the sheet overlaps with the center in the length direction of the sheet heating body.

3. The fixing device according to claim 1, further comprising:

a size information acquisition section configured to acquire size information indicating a size of the sheet; and a position deciding section configured to determine either of a position at which a temperature of a predetermined portion heated by the first heat element can be measured and a position at which a temperature of a predetermined portion heated by the second heat element can be measured as the destination of the both-end temperature measurement section based on the size information.

4. The fixing device according to claim 3, wherein the power controller is further configured to supply electric power to at least one of the first heat element and the second heat element without supplying the electric power to the center heat element until the temperature measured by the center temperature measurement section and the temperature measured by the both-end temperature measurement section become temperatures within the predetermined range if a temperature difference between the temperature measured by the center temperature measurement section and the temperature measured by the both-end temperature measurement section is beyond the predetermined range, and a position decided by the position deciding section is where the temperature of a predetermined portion heated by the first heat element can be measured.

5. The fixing device according to claim 3, wherein the power controller is configured to supply the electric power to the center heat element and at least one of the first heat element and the second heat element until the temperature measured by the center temperature measurement section becomes a predetermined temperature if a temperature difference between the temperature measured by the center temperature measurement section and the temperature measured by the both-end temperature measurement section is within the predetermined range, and a position decided by the position deciding section is where the temperature of a predetermined portion heated by the first heat element can be measured.

6. The fixing device according to claim 3, wherein the position deciding section is further configured to decide a position where the temperature of a predetermined portion heated by the second heat element can be measured as the position of the both-end temperature measurement section if half of a size in the width direction of the sheet indicated by the size information is equal to a distance between a center of the center heat element and a center of the first heat element.

7. The fixing device according to claim 3, wherein the position deciding section is further configured to decide a position where the temperature of a predetermined portion heated by the first heat element can be measured as the position of the both-end temperature measurement section if half of the size in the width direction of the sheet indicated by the size information is equal to a distance between a center of the center heat element and a center of the first heat element.

8. The fixing device according to claim 1, wherein the center heat element is connected to a first circuit comprising an AC power supply for supplying the electric power and a control selector switch for switching a state of the first heat element or the second heat element between a connection state with the AC power supply and a disconnection state from the AC power supply, and is supplied with the electric power from the AC power supply by the first circuit, and the first heat element or the second heat element is connected to a second circuit which comprises the AC power supply and the control selector switch and does not comprise the center heat element, and is supplied with the electric power from the AC power supply by either the first circuit or the second circuit.

9. The fixing device according to claim 8, wherein the power controller controls the electric power supply to the center heat element, to the first heat element, and to the second heat element by setting the state of either the first circuit or the second circuit to an ON state according to the temperatures measured by the center temperature measurement section and the both-end temperature measurement section.

10. An image forming apparatus comprising the fixing device according to claim 1.

11. The image forming apparatus according to claim 10, further comprising:

a size information acquisition section configured to acquire size information indicating a size of the sheet; and a position deciding section configured to determine either of a position at which a temperature of a predetermined portion heated by the first heat element can be measured and a position at which a temperature of a predetermined portion heated by the second heat element can be measured as the destination of the both-end temperature measurement section based on the size information.

12. A fixing method, comprising:

heating a sheet heating body having a cylindrical shape with at least one of a center heat element, a first heat element, and a second heat element, the center heat element generates heat in a central area containing a center in a length direction perpendicular to a circumferential direction of the sheet heating body, the first heat element generates heat in a first area containing an end in the length direction and at which a boundary is positioned at a position away from a boundary of the central area by a predetermined distance in the length direction, and the second heat element generates heat in a second area between the central area and the first area and does not overlap with the central area and the first area, and a line connecting the center of the central area and a center in the length direction of the sheet heating body is perpendicular to the surface of the sheet heating body;

measuring a temperature of a portion of the sheet heating body heated by the center heat element;

moving in the length direction and measuring a temperature of the sheet heating body at a destination; and controlling electric power supplied to the center heat element, to the first heat element, and to the second heat element according to the temperatures measured at the portion heated by the center heat element and at the destination, wherein if the temperatures measured at the portion heated by the center heat element and at the destination are not within a predetermined range, independently controlling electric power supplied to the center heat element, to the first heat element, and to the second heat element, and wherein if the temperatures measured at the portion heated by the center heat element and at the destination are within the predetermined range, integrally controlling electric power supplied to the center heat element, to the first heat element, and to the second heat element.

13. The fixing method according to claim 12, further comprising:

conveying a sheet in such a manner that a center thereof in a width direction orthogonal to a conveyance direction of the sheet overlaps with the center in the length direction of the sheet heating body.

14. The fixing method according to claim 12, further comprising:

acquire size information indicating a size of a sheet; and determining either of a position at which a temperature of a predetermined portion heated by the first heat element can be measured and a position at which a temperature of a predetermined portion heated by the second heat element can be measured as the destination based on the size information.

15. The fixing method according to claim 14, further comprising:

supplying electric power to at least one of the first heat element and the second heat element without supplying the electric power to the center heat element until the temperatures measured at the portion heated by the center heat element and at the destination become temperatures within the predetermined range if a temperature difference between the temperatures measured at the portion heated by the center heat element and at the destination is beyond the predetermined range, and a position determined is where the temperature of a predetermined portion heated by the first heat element can be measured.

16. The fixing method according to claim 14, further comprising:

supplying the electric power to the center heat element and at least one of the first heat element and the second heat element until the temperature measured at the portion heated by the center heat element becomes a predetermined temperature if a temperature difference between the temperatures measured at the portion heated by the center heat element and at the destination is within the predetermined range, and a position determined is where the temperature of a predetermined portion heated by the first heat element can be measured.

17. The fixing method according to claim 14, further comprising:

deciding a position where the temperature of a predetermined portion heated by the second heat element can be measured as the position at the destination if half of a size in the width direction of the sheet indicated by the size information is equal to a distance between a center of the center heat element and a center of the first heat element.

18. The fixing method according to claim 14, further comprising:

deciding a position where the temperature of a predetermined portion heated by the first heat element can be measured as the position at the destination if half of the size in the width direction of the sheet indicated by the size information is equal to a distance between a center of the center heat element and a center of the first heat element.

19. The fixing method according to claim 12, wherein the center heat element is connected to a first circuit comprising an AC power supply for supplying the electric power and a control selector switch for switching a state of the first heat element or the second heat element between a connection state with the AC power supply and a disconnection state from the AC power supply, and is supplied with the electric power from the AC power supply by the first circuit, and the first heat element or the second heat element is connected to a second circuit which comprises the AC power supply and the control selector switch and does not comprise the center heat element, and is supplied with the electric power from the AC power supply by either the first circuit or the second circuit.

20. The fixing method according to claim 19, further comprising:

controlling the electric power supply to the center heat element, to the first heat element, and to the second heat element by setting the state of either the first circuit or the second circuit to an ON state according to the temperatures measured at the portion heated by the center heat element and at the destination.

* * * * *